US005447334A

United States Patent [19]

Hartsock

[11] Patent Number: 5,447,334

[45] Date of Patent: Sep. 5, 1995

[54] TABBED FILE FOLDER

[76] Inventor: Eric Hartsock, 5944 Hemlock, Merriam, Kans. 66202

[21] Appl. No.: 297,020

[22] Filed: Aug. 29, 1994

[51] Int. Cl.[6] ..... B42D 3/00

[52] U.S. Cl. ..... 281/45; 493/210; 493/947; 206/425

[58] Field of Search ..... 281/45, 42; 283/116, 283/117, 36; 402/70, 73; 493/947, 210; 206/425

[56] References Cited

U.S. PATENT DOCUMENTS 5,141,485 8/1992 Welt ..... 493/947 X
5,174,606 12/1992 Hure ..... 493/947 X

FOREIGN PATENT DOCUMENTS 2227457 8/1990 United Kingdom ..... 493/947

*Primary Examiner*—Willmon Fridie
*Attorney, Agent, or Firm*—Hovey, Williams, Timmons & Collins

[57] ABSTRACT

A one-piece file folder is provided with an integral tab structure. The preferred file folder broadly includes a paperboard body formed into a plurality of panels hingedly connected by a fold line. The panels are folded along the fold line and secured to form an assembled file folder. The file folder also includes an integral tab structure cut from one of the panels which presents a fold line common to the paperboard body fold line. The tab structure pivots about the fold line so that it either extends from the assembled file folder or lies flat relative to the assembled file folder.

7 Claims, 1 Drawing Sheet

TABBED FILE FOLDER

BACKGROUND OF THE INVENTION

1. Field of the Invention

The present invention relates to paper holding devices such as folders, and more particularly to tabbed file folders including integral tab structures for easy identification.

2. Description of the Prior Art

Conventional folders are commonly used to hold and store loose pieces of paper. These prior art folders are typically constructed with one or more pouches or pockets and are decorated with designs or messages. Although these prior art folders are effective for individually storing loose paper, they suffer from several limitations when used as organizers. For example, when a plurality of folders are used, they are often stacked or placed in hanging-file drawers. Since the folders have no tabs or other means of identification, they are difficult to identify and separate.

It is known to provide separate tab structures for placement on file folders. These tabs allow the file folder to be more readily identified when stacked or placed in a hanging file drawer. These tabs are typically formed of paperboard or plastic and are fastened to the file folder before the folder is placed in a drawer for storage. Although these tabs effectively identify the folders, they also suffer from several limitations. For example, since the tabs are formed separately from the file folder, they must be fastened to the folder with glue or other attachment methods. Additionally, since the tabs are formed separately from the folder, they require additional material and thus increase the costs of the folders. Finally, these separate tabs are awkward because they stick out from the folder when the folder is removed from storage and used. Thus, the tabs are easily damaged and become snagged on other objects.

Thus, the prior art points out the need for an improved file folder which provides for easy identification without suffering from the limitations inherent in separate tab structures.

SUMMARY OF THE INVENTION

It is an object of the present invention to provide a file folder which can be easily identified when stacked or hung in a hanging file drawer.

It is another object to provide a file folder with an integral tab structure.

It is another object to provide a file folder formed from a paperboard blank with a tab formed from the same paperboard blank as the folder.

It is still another object to provide a file folder with a tab which can be pivoted to either extend from the file folder or lie flat relative to the folder.

In accordance with these objects and other objects evident from the following description of the invention, a file folder is provided with an integral tab structure. The preferred tabbed file folder broadly includes a paperboard body formed into a plurality of panels hingedly connected by a fold line. The panels are folded along the fold line and secured to form an assembled file folder. The file folder also includes an integral tab structure. The tab structure is cut from one of the panels and presents a fold line common to the paperboard body fold line. The tab structure is operable to pivot about the fold line so that it either extends from the assembled file folder or lies flat relative to the assembled file folder.

The construction of the present invention provides numerous advantages. For example, since the tabs are formed integrally as part of the file folder, they do not have to be fastened to the folder with glue or other adhesives. Additionally, the integral nature of the tabs eliminates waste since no extra material is needed to form the tabs. Thus, the present tabbed file folder is less expensive to manufacture and saves natural resources.

A further advantage is that messages can be printed on the tab at the same time messages are printed on the folder body. This saves a printing step when creating pre-printed file folders. A further advantage is that the tabbed file folder can be simultaneously used as both a conventional folder and a hanging file folder since the tab structure can pivot about the fold line to either extend from the assembled file folder or lie flat relative to the assembled file folder. Moreover, since the tabs can be retracted when the file folder is removed from a hanging file drawer, the tabs resist damage and won't become snagged on other objects.

BRIEF DESCRIPTION OF THE DRAWINGS

A preferred embodiment of the present invention is described in detail below with reference to the attached drawing figures, wherein.

DETAILED DESCRIPTION OF THE PREFERRED EMBODIMENTS

Figures 1, 2, 3, 4, 5:
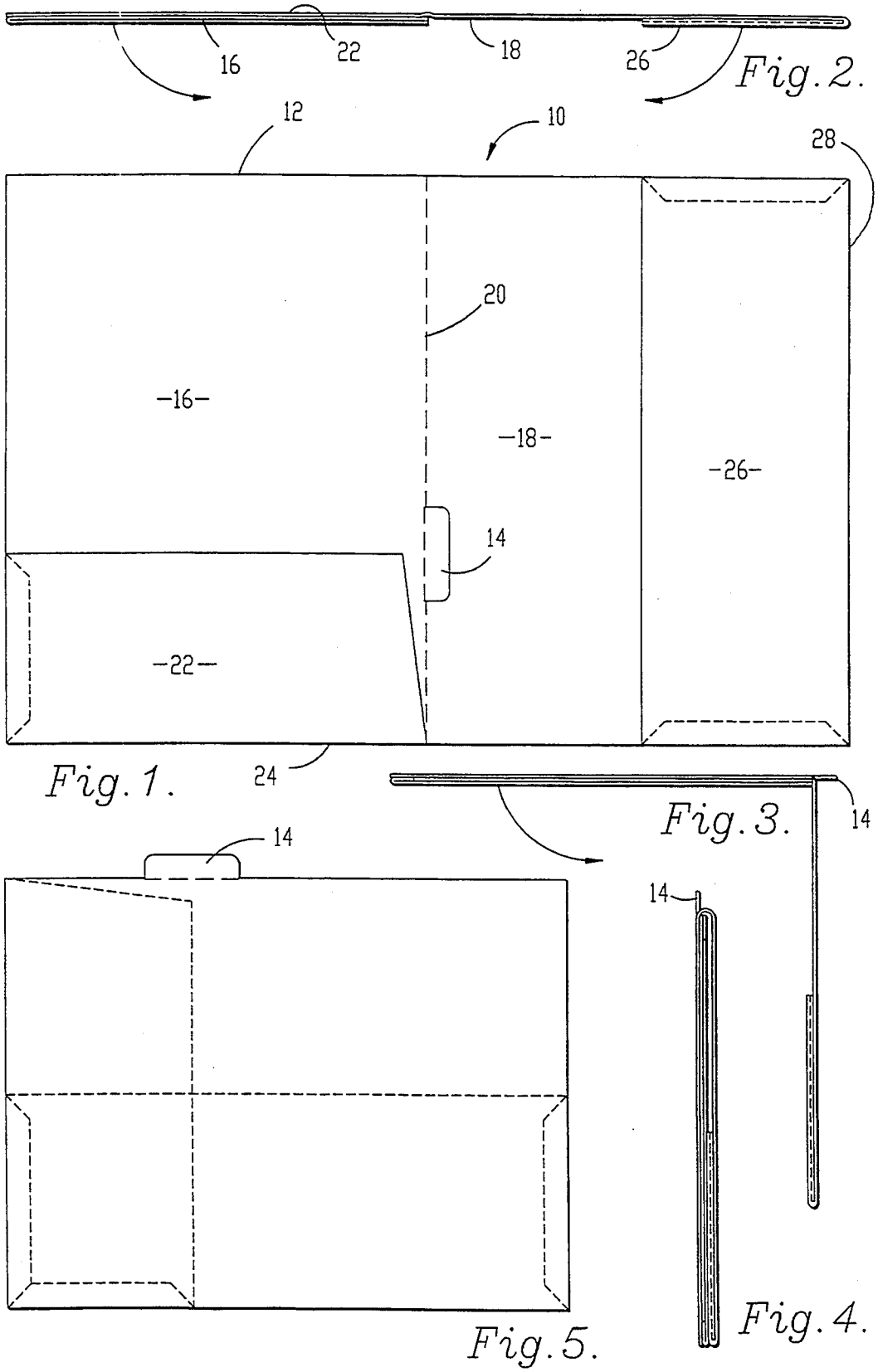
FIG. 1 is a top view of the interior of a tabbed file folder constructed in accordance with the preferred embodiment.
FIG. 2 is a side view of the file folder shown in its open position.
FIG. 3 s a side view of the file folder shown partially folded.
FIG. 4 is a side view of the file folder shown completely folded.
FIG. 5 is a front view of the file folder.

Turning now to the drawings, and particularly FIG. 1, a file folder 10 constructed in accordance with the preferred embodiment is illustrated. The file folder broadly includes a folder body 12 and an integral tab structure 14.

In more detail, the folder body 12 is cut from a blank formed of a lightweight paperboard material. In preferred forms, the folder body includes a cover panel 16 and a rear panel 18 hingedly connected by a first fold line 20. The fold line is formed by scoring or perforating the folder body at the appropriate location in a conventional manner.

In preferred forms, the cover panel includes a cover panel bottom end flap 22 hingedly connected thereto by a second fold line 24. The rear panel includes a rear panel end flap 26 hingedly connected thereto by a third fold line 28.

The folder body 12 is easily assembled in three steps by folding the panels about their respective fold lines and securing them with a conventional adhesive. First, the cover panel bottom end flap 22 is folded about the second fold line 24 to overlie a portion of the cover panel 16. The edges of the cover panel bottom end flap are then secured to the cover panel with adhesive. As best illustrated in FIG. 1, once folded, the cover panel and cover panel bottom end flap form a pocket for the storage of loose paper and other materials. Second, the rear panel end flap 26 is folded about the third fold line 28 to overlie a portion of the rear panel 18. The edges of the rear panel end flap are then secured to the rear panel with adhesive. Once folded, the folded rear panel and rear panel end flap form a second pocket. Third and finally, the cover panel is folded about the first fold line to overlie the rear panel to form an assembled file folder.

The file folder 10 also includes an integral tab structure 14. As best illustrated in FIG. 1, the tab structure 14 is integrally cut from a portion of the folder body 12. The tab can be die-cut while forming the folder body or can be subsequently cut at a second cutting station. In preferred forms, the tab 14 is cut from a portion of either the cover panel 16 or the rear panel 18 bordering on the first fold line 20. As illustrated in FIG. 5, the tab presents a flat surface for the inscription of identifying information thereon. Since the tab is an integral part of the folder body, messages can be advantageously printed on the tab at the same time messages are printed on the folder body, thus saving a printing step.

As illustrated in FIG. 1, one side of the tab is not cut from the folder body so that it remains attached to the folder body along the first fold line 20. Thus, the tab has a fold line common to the first fold line and can pivot about the fold line. With this arrangement, the tab structure can be shifted between different positions by merely pivoting it about its fold line. For example, as best illustrated in FIGS. 4 and 5, the tab structure can be positioned so that it extends from the assembled file folder for easy identification. With the tab extended, the folder can be placed in a hanging file folder with other files and can be easily identified. Alternatively, as illustrated in FIG. 1, the tab can be positioned so that it lies flat relative to the assembled file folder. In this way, the tab is hidden from view and the folder can be removed from the hanging file folder and used without fear of damaging the tab structure or snagging it on other objects.

In preferred forms, the tab structure is rectangular-shaped. However, as those skilled in the art will appreciate, the tabs can be cut in a variety of shapes and sizes. For example, to appeal to young children, the tabs can be formed in the shape of cartoon characters, balloons, dinosaurs or similar objects. Additionally, the tab structure may be sized and shaped to receive a business card or business logo for marketing purposes.

In use, the tabbed file folder can be simultaneously used as both a conventional folder and a hanging file folder. To create a tabbed file folder, the folder body is first assembled by merely folding the multiple panels about their respective fold lines and securing them with a conventional adhesive. The folder can then be quickly and easily converted from a conventional folder to a hanging file folder by merely pulling the tab outward so that it extends from the assembled folder body.

Although the invention has been described with reference to the preferred embodiments illustrated in the attached drawing figures, it is noted that equivalents may be employed and substitutions made herein without departing from the scope of the invention as recited in the claims. For example, although the invention has been described as a file folder, the integral tab can be formed in a variety of paper storage objects such as envelopes. Additionally, as those skilled in the art will appreciate, the size of the tab may be varied to suit a variety of applications.

Having thus described the preferred embodiments of the invention, what is claimed as new and desired to be protected by Letters Patent includes:

1. A tabbed folder comprising:

a folder body including a cover panel and a rear panel hingedly connected by a cover panel and rear panel fold line, wherein said cover panel and rear panel are folded along said cover panel and rear panel fold line to form an assembled folder; and an integral tab structure cut from one of said cover panel or rear panel, said tab being hingedly connected to said folder body by a tab fold line common to said cover panel and rear panel fold line, wherein said tab structure is operable to pivot about said tab fold line so that it can be selectively positioned to extend from said assembled file folder or lie flat relative to said assembled file folder.

2. A tabbed folder as recited in claim 1, wherein said tab structure is die-cut from one of said cover panel or rear panel.

3. A tabbed folder as recited in claim 2, wherein said tab structure is rectangular-shaped.

4. A tabbed folder as recited in claim 2, wherein said tab structure is animal-shaped.

5. A tabbed folder as recited in claim 1, wherein said folder body is formed from a paperboard blank.

6. A tabbed folder as recited in claim 1, wherein said folder body further includes a cover panel bottom end flap hingedly connected to said cover panel by a cover panel bottom end flap hinge line and a rear panel end flap hingedly connected to said rear panel by a rear panel bottom end flap hinge line.

7. A method of producing a one-piece tabbed file folder, comprising the steps of:

providing a paperboard blank;

scoring said paperboard blank to form a file folder including a cover panel and a rear panel hingedly connected together by a cover panel and rear panel fold line;

folding said cover panel and said rear panel along said cover panel and rear panel fold line to form an assembled file folder; and cutting an integral tab from a portion of one of said cover panel or said rear panel bordering said cover panel and rear panel fold line so that said tab presents a tab fold line common to said cover panel and rear panel fold line.

* * * * *